US009464378B2

(12) United States Patent
Chen

(10) Patent No.: US 9,464,378 B2
(45) Date of Patent: Oct. 11, 2016

(54) WATER CHAMBER FOR A STEAM GENERATING DEVICE

(71) Applicant: KONINKLIJKE PHILIPS N.V., Eindhoven (NL)

(72) Inventor: Sen Kee Chen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/409,713

(22) PCT Filed: Jun. 24, 2013

(86) PCT No.: PCT/IB2013/055162

§ 371 (c)(1),
(2) Date: Dec. 19, 2014

(87) PCT Pub. No.: WO2014/001989

PCT Pub. Date: Jan. 3, 2014

(65) Prior Publication Data

US 2015/0337484 A1 Nov. 26, 2015

Related U.S. Application Data

(60) Provisional application No. 61/663,658, filed on Jun. 25, 2012.

(51) Int. Cl.
*D06F 75/14* (2006.01)
*D06F 87/00* (2006.01)

(52) U.S. Cl.
CPC ..... *D06F 75/14* (2013.01); *D06F 87/00* (2013.01)

(58) Field of Classification Search
CPC ..... D06F 75/14; D06F 75/16; D06F 75/18; D06F 75/36; D06F 87/00
See application file for complete search history.

(56) References Cited

U.S. PATENT DOCUMENTS

| | | | | |
|---|---|---|---|---|
| 2,384,839 | A * | 9/1945 | Kistner | D06F 5/18 38/77.7 |
| 2,553,274 | A * | 5/1951 | Pohl | D06F 5/16 219/251 |
| 2,768,455 | A * | 10/1956 | Hoecker | D06F 5/16 38/77.82 |
| 2,861,365 | A * | 11/1958 | Block | A63H 33/30 219/245 |
| 3,104,482 | A * | 9/1963 | Ivar | D06F 5/18 219/252 |
| 4,920,668 | A | 5/1990 | Henneberger | |
| 2011/0265354 | A1 | 11/2011 | Krishnan | |

FOREIGN PATENT DOCUMENTS

| | | | |
|---|---|---|---|
| CN | 2733174 | Y | 10/2005 |
| DE | 1766129 | U | 5/1958 |
| DE | 4141370 | A1 | 6/1993 |
| GB | 2256652 | A | 12/1992 |
| WO | 2011076546 | A1 | 6/2011 |

* cited by examiner

*Primary Examiner* — Ismael Izaguirre

(57) ABSTRACT

The present application relates to a water chamber (6) for a steaming appliance comprising a housing (8) having a base, an opening (15) in the housing through which water is able to be fed into the water chamber, and a wall (23) distending from the housing into the water chamber to define a passage (25) in the water chamber extending from the opening, the distance between the level of an upper edge of a lower end (24) of the wall and the base being less than the distance between the level of a lower edge (21) of the opening and the base so that water is restricted from flowing along the passage from the water chamber when the water chamber is tilted from its normal operating orientation. The present application also relates to a base unit for a steaming appliance, a garment steamer and a steam system iron.

12 Claims, 4 Drawing Sheets

WATER CHAMBER FOR A STEAM GENERATING DEVICE

This application is the U.S. National Phase application under 35 U.S.C. §371 of International Application No. PCT/IB2013/055162, filed on Jun. 24, 2013, which claims the benefit of U.S. Provisional Application No. 61/663,658 filed on Jun. 25, 2012. These applications are hereby incorporated by reference herein.

FIELD OF THE INVENTION

The present invention relates to a water chamber for a steam generating device. The present invention also relates to a base unit for a steam generating device, a garment steamer and a steam system iron.

BACKGROUND OF THE INVENTION

A steam system iron produces steam which is generally directed towards a garment to remove creases from the garment. Such a steam system iron or steam generator iron has a base unit and a head unit. The base unit has a water chamber in which a quantity of water is stored. Water is fed from the water chamber to a steam generator to convert the water into pressurized steam. A flexible hose extends between the base unit and the head unit through which steam produced by the steam generator is fed to the head unit.

The head unit is held by a user and has a sole plate which is pressed against the fabric of a garment. Pressurized steam generated by the steam generator in the base unit flows along the hose to the head unit and is discharged from the head unit through holes in the sole plate which is then applied to a fabric of a garment to remove creases from the fabric.

Water in the water chamber is fed to the steam generator by a fluid pump. The steam generator then heats the water fed from the water chamber to convert the water into steam at a high pressure, which is then exhausted from the steam generator through a steam outlet to the flexible hose.

To fill the water chamber with a quantity of water, an opening is provided in the housing of the water chamber through which water is fed.

However, a problem with providing a water inlet to the water chamber is that water is able to leak through the opening defining the water inlet when the base unit is tilted from its normal orientation. For example, with some system irons it is known to mount the head unit to the base unit for transportation and storage. During transportation the assembled unit may be held by a handle of the head unit. This causes the base unit to tilt with respect to its normal operating position. Therefore, water in the water chamber in the base unit flows towards the water inlet and is able to spill from the base unit.

It is known to provide a one-way valve to prevent water leakage through the water inlet to the water chamber. However, existing valves tend to have a complicated arrangement.

SUMMARY OF THE INVENTION

It is an object of the invention to provide a water chamber for a steam generating device which substantially alleviates or overcomes the problems mentioned above.

According to embodiments of the present invention, there is provided a water chamber for a steaming appliance comprising a housing having a base, an opening in the housing through which water is able to be fed into the water chamber, and a wall distending from the housing into the water chamber to define a passage in the water chamber extending from the opening, the distance between the level of an upper edge of a lower end of the wall and the base being less than the distance between the level of a lower edge of the opening and the base so that water is restricted from flowing along the passage from the water chamber when the water chamber is tilted from its normal operating orientation.

Therefore, the wall and the passage defined by the wall can act as a water lock. Water is prevented from flowing out of the water chamber through the opening when the water chamber is tilted from its normal operating position. This means that a user is able to manoeuvre the water chamber, and therefore the base unit, without spilling water contained in the water chamber.

The opening may be provided at an upper portion of the housing.

The water chamber may have a base and the level of the upper edge of the lower end of the wall may extend closer to the base than the level of a lower edge of the opening.

The distance between the level of the upper edge of the lower end of the wall and the level of the lower edge of the opening may be equal to the product of the distance between the upper edge of the lower end of the wall and the lower edge of the opening, and the sine of the maximum angle that the lower edge of the opening is rotatable relative to the upper edge of the lower end of the wall from the normal operating orientation of the water chamber prior to water flowing out of the opening when the level of water in the water chamber in its normal operating orientation is equal to the level of the upper edge of the lower end of the wall.

The difference between the level of the upper edge of the lower end of the wall and the level of the lower edge of the opening may be at least 3 mm.

The water chamber may further comprise a panel extending across the passage, wherein one or more apertures may be defined in the panel.

Therefore, it is possible to restrict the ingress of detritus into the water chamber.

The level of the upper edge of the lower end of the wall may be defined as the edge of the one or more apertures defined in the panel.

The wall may extend around the periphery of the opening to define the passage.

The housing may have a sidewall, the wall and the sidewall being arranged such that the passage is defined between the wall and the sidewall.

Therefore, the passage is easily formed in the housing.

The water chamber may further comprise an air release aperture formed in the wall to allow the release of air when water is fed into the water chamber through the opening.

With the above arrangement, air blockages are prevented during filling of the water chamber with water.

The air release aperture may be disposed between a lower edge of the opening and the lower end of the wall.

Therefore, the air release aperture is submerged when the water chamber is tilted at an angle from its normal operating position and air is not able to escape through the air release aperture.

The housing may comprise an upper wall and the wall may distend downwardly from the upper wall.

The housing may further comprise a water inlet part, the opening and the wall being defined by the water inlet part.

Therefore, the opening and the wall are easily formed.

According to another aspect of embodiments of the invention, there is provided a base unit for a steaming appliance comprising a water chamber according to any preceding claim.

The base unit may further comprise a steam generator and/or a pump for supplying water to the steam generator.

According to another aspect of embodiments of the invention, there is provided a garment steamer comprising a base unit.

According to another aspect of embodiments of the invention, there is provided a system steam iron comprising a base unit.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
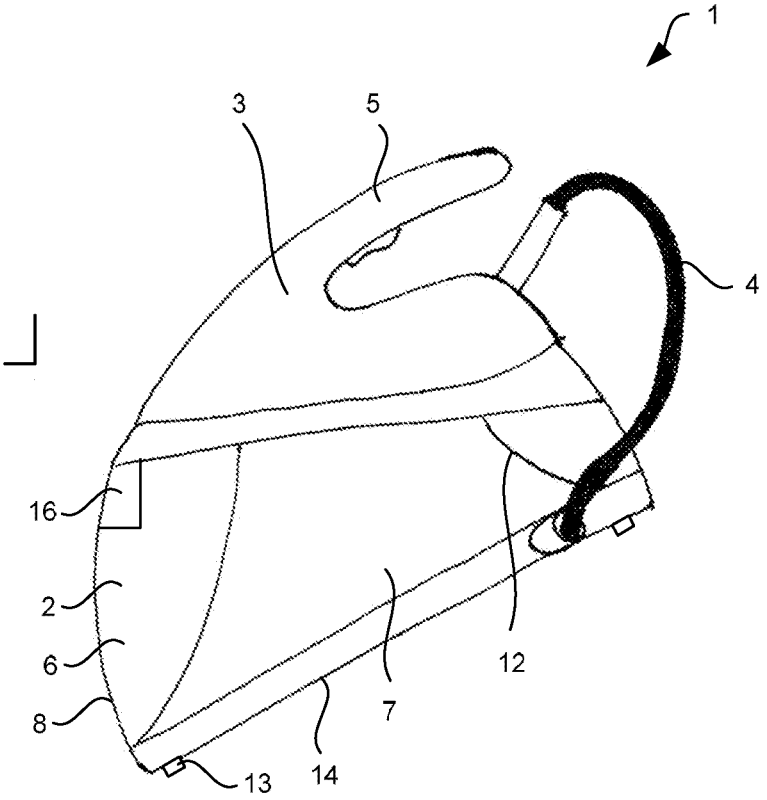
FIG. 1 shows a side view of a base unit for a steam generating device orientated in a tilted position.

Referring now to FIG. 1, a steam system iron 1 is shown. Such an iron is also known as a steam generator iron and comprises a base unit 2, a head unit 3, and a flexible hose 4. The flexible hose connects the base unit 2 to the head unit 3. The base unit 2 is configured to be located on a horizontal surface and the head unit 3 is configured to be held and manoeuvred by a user. The head unit 3 has a handle 5 to aid grasping and manoeuvring of the head unit 3. The head unit 3 is locatable on the base unit 2 for storage and also to aid manoeuvring of the steam system iron. The head unit 3 is configured to be removably mountable to the base unit 2. When the head unit 3 is mounted to the base unit 2, the combined base unit 2 and head unit 3 are able to be held and manoeuvred by a user grasping the handle 5 of the head unit 3.

The base unit 2 has a water chamber 6 and a component chamber 7. The water chamber 6 is configured to hold water, which is to be converted into steam. Components to operate the steam system iron are disposed in the component chamber 7. A boiler (not shown), acting as a steam generator, is disposed in the component chamber 7. The boiler (not shown) is configured to convert water fed from the water chamber 6 into steam. A pipe (not shown), acting as a fluid passageway, fluidly communicates the water chamber 6 with the boiler. Therefore, water in the water chamber 6 is able to be fed to the boiler. A pump (not shown) is disposed along the fluid passageway to feed water from the water chamber 6 to the boiler.

A steam outlet (not shown) communicates between the boiler and the flexible hose 4. Therefore, the boiler is in fluid communication with the flexible hose 4. Steam under a high pressure produced by the boiler is fed from the boiler to the flexible hose 4. As the steam is at a high pressure, the steam flows along the flexible hose 4 to the head unit 3. The head unit 3 has a sole plate (not shown) with holes formed therein. Steam fed through the hose to the head unit 3 flows through the holes in the sole plate to be directed to a garment for steaming and/or ironing.

The base unit 1 has a power supply unit (PSU). The PSU (not shown) is disposed in the component chamber 7. The PSU supplies electrical power to components in the base unit 1, for example the boiler and the pump. A controller (not shown) is disposed in the component chamber 7. The controller is configured to operate components of the steam system iron, such as the boiler and pump.

Conductive wires (not shown) are disposed in the flexible hose 4 to electrically connect the base unit 2 with the head unit 3. That is, the wires are configured to pass electrical power and electrical signals between the base and head units 2, 3. A user input unit, for example one or more switches and/or dials are disposed on the head unit and/or base unit. Therefore, the controller is configured to operate the steam system iron 1 in response to a user input.

Figure 2:
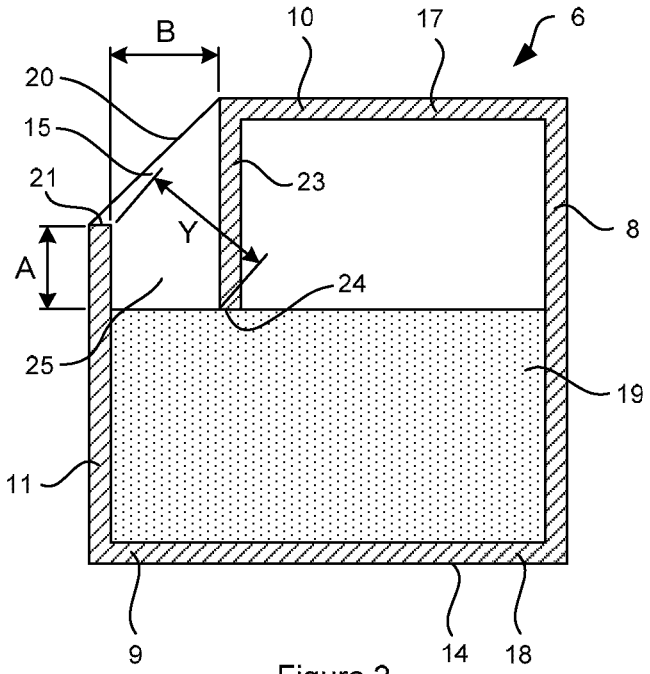
FIG. 2 shows a schematic cross-sectional side view of a water chamber of the base unit shown in FIG. 1 in a normal operating position.
Figure 3:
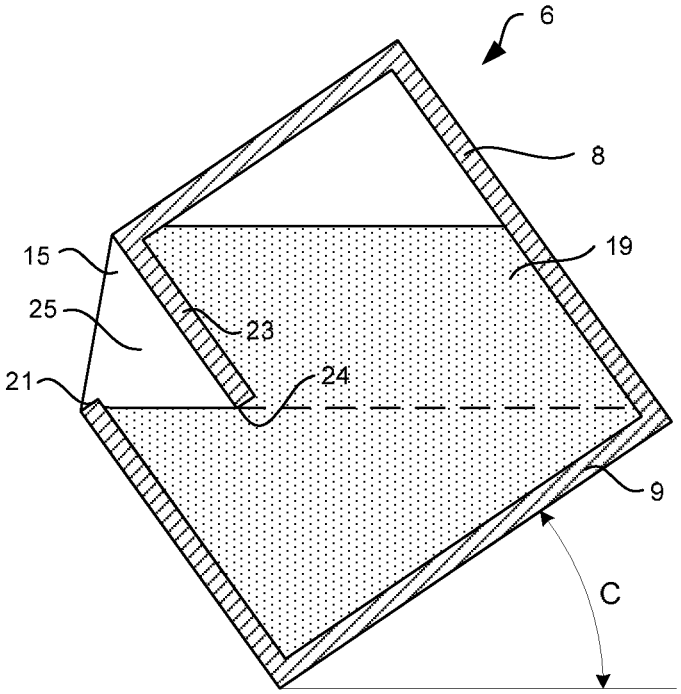
FIG. 3 shows a schematic cross-sectional side view of the water chamber of the base unit shown in FIG. 1 orientated in a tilted position.

Referring to FIGS. 2 and 3, the water chamber 6 is shown. The water chamber 6 acts as a water reservoir for storing water to be converted into steam. The water chamber 6 is defined by a housing 8. The housing 8 defines an outer shell of the water chamber 6. The housing is formed from a rigid material, for example a plastic. At least part of the housing is translucent or transparent to allow a user to view the water level in the water chamber 6. Therefore, the user is able to determine when the quantity of water in the water chamber 6 is running dry, and so is able to determine when the water chamber 6 needs refilling with water.

The housing 8 of the water chamber 6 has a base part 9 and a top part 10. The housing 8 also has an outer sidewall 11 and an inner sidewall 12 (refer to FIG. 1). The outer sidewall 11 extends between the base part 9 and the top part 10. The base part 9, top part 10 and outer sidewall 11 determine the outer extremities of the water chamber 8. The inner sidewall 12 is received in the space defined by the outer sidewall 11. The inner sidewall 12 extends between the base part 9 and the top part 10. The inner sidewall 12 defines the component chamber 7. In the present embodiment, the component chamber 7 is received within the footprint of the water chamber 6 so that the water chamber 6 extends around the periphery of the component chamber 7. However, it will be understood that the base unit may have an alternative arrangement, for example the component chamber 7 may be disposed below, above or to one side of the water chamber 6. In such arrangements, it will be appreciated that the inner sidewall 12 may be omitted.

In the present arrangement, the base part 9 forms the base of the base unit 2. The base part 9 has a base face 14. The base face 14 is configured to be placed on a horizontal surface, such as a table top or a kitchen unit. Alternatively, support feet 13, such as rubber nubs, are mounted to the base face 14, so that the base face extends parallel to, but spaced from, the horizontal surface (refer to FIG. 1). When the base unit 2 is positioned on the horizontal surface, it will be understood that the base unit 2, and therefore the water chamber 6 is in its normal operating position. That is, the base unit 2, and therefore the water chamber 6, is in its correct orientation for operation.

The top part 10 extends across the upper end of the water chamber 6. The top part 10 is fixedly mounted to the outer sidewall 11. However, it will be understood that the top part 10 may be removable to allow access to the water chamber 6, or may be integrally formed with the outer sidewall 11. Similarly, the base part 9 may be integrally formed with the outer sidewall 11. The top part 10 is configured to releasably mount the head unit 3 to the base unit 2 by use of a head unit receiving slot and a catch. Therefore, the head unit 3 is able to be fixedly mounted to the base unit 2 so that a user may pick up the combined base unit 2 and head unit 3.

The top part 10 defines an upper wall 17 of the housing 8 of the water chamber 6. The base part 9 defines a lower wall 18 of the housing 8 of the water chamber 6.

An opening 15 is formed in the housing 8 of the water chamber 6. The opening 15 communicates a water receiving space 19 of the water chamber 6 with outside of the water chamber 6. Therefore, it is possible to feed water into the water chamber 6 through the opening 15 to fill the water chamber 6.

The opening 15 of the water chamber 6 is formed at an upper end of the housing 8. In the present embodiment, the opening 15 is formed by a water inlet part 16 (refer to FIG. 1).

The water inlet part 16 extends downwardly from the top part 10 and is received in a recess formed in the outer sidewall 11. The opening 15 is formed in the water inlet part 16. However, it will be understood that the opening 15 may be formed in the outer sidewall 11 and/or top part 10. Such arrangements are shown schematically in FIGS. 2 to 5.

In FIGS. 2 and 3 the water chamber 6 is shown schematically in cross-section. The water inlet part 16 is not shown and the opening 15, outer sidewall 11 and top part 10 are integrally formed. The upper wall 17, the lower wall 18 and the outer sidewall 11 define the water receiving space 19. The opening 15 is formed in the upper wall 17 and the outer sidewall 11. In an alternative arrangement the opening 15 is formed in the upper wall 17 only.

The opening 15 has a peripheral edge 20 defining the extent of the opening. A lower edge 21 of the peripheral edge 20 defines the distance between the opening 15 and the base of the water chamber 6. That is, the lower edge 21 of the peripheral edge 20 of the opening 15 is at a level above the base of the water chamber 6.

A wall 23, acting as a separation wall, distends downwardly from the upper wall 17. The wall 23 extends into the water receiving chamber from the housing 8. The wall 23 extends from the upper wall 17 and has a lower end 24 at its free end. The wall 23 extends along the peripheral edge 20 of the opening 15 in the housing 8. The wall 23 extends from the outer sidewall 11 along the wall's vertical edges. The wall 23 defines a passage 25. That is, a passage 25 is defined between the wall 23 and the outer side wall 11. The passage 25 extends from the opening 15 to the lower end 24 of the wall 23. Therefore, the passage 25 defined by the wall 23 is separated from the remainder of the space defined by the housing 8 by the wall 23. The wall 23 in the present embodiment forms a generally U-shape, although the shape of the wall 23 is generally dependent on the shape and orientation of the opening 15 in the housing 8.

The level of an upper edge of the lower end 24 of the wall 23 extends below the level of the lower edge 21 of the opening 15. That is, the distance between the level of the lower edge 21 of the opening 15 and a base, for example defined by the lower wall 18 of the water chamber 6, is greater than the distance between the level of the upper edge of the lower end 24 of the wall 23 and a base defined by the lower wall 18 of the water chamber 6. The level of the upper edge of the lower end 24 of the wall 23 is defined by the level of the uppermost part of the free end of the wall 23. The lower end 24 of the wall 23 is spaced from the lower edge 21 of the opening 15. The distance between the level of the upper edge of the lower end 24 of the wall 23 and the level of the lower edge 21 of the opening 15 is shown in FIG. 2 by notation 'A'. The width of the passage 25 between the wall 23 and the outer sidewall 11 is shown in FIG. 2 by notation 'B'. In FIG. 3, the angle of rotation of the water chamber 6 from its normal operating orientation is shown in FIG. 3 by notation 'C'.

The wall 23 separates the passage 25 from a portion of the space defined by housing 8, but is open at one end to the space. The portion of the space defined by the housing and the wall 23 extends above the level of the upper edge of the lower end 24 of the separation wall 23.

When a user fills the water chamber 6 with water, water is fed through the opening 15. The water flows along the passage 25 defined by the wall 23 and the outer wall 11 and into the water receiving space 19 in the housing 8. The water fills up the water chamber 6, and an indicator (not shown) indicates to a user that the maximum water level has been reached. In the present embodiment, the maximum indicator is determined as the level of the upper edge of the lower end 24 of the wall 23 defined when the water chamber 6 is in its normal operating position, that is the base unit 2 is disposed on a horizontal surface. In the present arrangement, the opening is accessible from a vertical aspect, however a user may find it easier to tilt the base unit with respect to its normal operating position such that the opening is more accessible.

When the water chamber 6 is filled with water, the user is able to operate the steam system iron 1, and therefore the base unit 2. Water in the water chamber 6 is fed to the boiler (not shown) to be converted into steam. The steam then flows from the head unit 3 and is directed towards a garment to be steamed.

When a user has finished operating the steam system iron 1, they are able to stand the head unit 3 on the base unit 2. The head unit 3 is mounted to the base unit 2 and so the user is able to pick up the base unit 2 and the head unit 3 as one combined unit. Therefore, a user is able to carry the combined unit by the handle 5 of the head unit 3. It will be understood that when the base unit 2 is maneuvered in this manner, or by other means, that the base unit 2, and therefore the water chamber 6, will be tilted at an angle to its normal operating position.

The angle of rotation of the water chamber 6 from its normal operating orientation is shown in FIG. 3 by notation 'C'. The base unit 2 is also shown tilted at an angle to its normal operating position in FIG. 1.

When the water chamber 6 is tilted at an angle to it normal operating position in the direction of the opening 15 in the housing 8, the water is urged to flow towards the opening 15. The housing 8 is rotated so that the level of the lower edge 21 of the opening 15 is below the level of the water in the water chamber 25. However, the wall 23 restricts the flow of water towards the opening 15 due to the wall 23 defining a passage 25. The wall 23 effectively creates a water lock which keeps the water from flowing out of the opening 15 despite the level of the water in the water chamber 6 being disposed above the level of the lower edge 21 of the opening 15.

It will be understood that the angle by which the water chamber 6 may be tilted from its normal operating position is dependent on the dimensions of the passage 25. In particular, the angle by which the water chamber 6 can be tilted without water flowing from through the opening 15 is dependent on the distance A of the passage 25 between the level of the upper edge of the lower end 24 of the wall 23 and the level of the lower edge 21 of the opening 15 and the width B of the passage 25 between the wall 23 and the outer side wall 11.

For example, to ensure water does not flow along the passage 25 and over the lip formed by the lower edge 21 of the opening 15, dimension A is greater than zero when water tank is tilted at an angle to its normal operating position. Air exchange along the passage 25 and into the remainder of the space is prevented when the water chamber 6 is tilted so that water does not flow out despite the level of the water being above the lower edge 21 of the opening 15 in a vertical direction.

Air is prevented from flowing into the space in the water chamber 6 above the lower end 24 of the wall 23 by the upper edge of the lower end of the wall being submerged in the water (below the water level as the water chamber is tilted). Therefore, the water is retained in the space (above the dashed line) by the water lock formed by the wall 23 and so the water is prevented from flowing along the passage 25 and out of the opening 15.

It will be understood that the angle C that can be achieved without water flowing from the water chamber 6 may be determined by the ratio between the distance A of the passage 25 between the level of the upper edge of the lower end 24 of the wall 23 and the level of the lower edge 21 of the opening 15 and the width B of the passage 25 between the wall 23 and the outer side wall 11.

The distance between the level of the upper edge of the lower end 24 of the wall 23 and the level of the lower edge 21 of the opening 15 is equal to the product of a distance 'Y' between the upper edge of the lower end 24 of the wall 23 and the lower edge 21 of the opening 15, and the sine of the maximum angle 'Z' that the lower edge 21 of the opening 15 is rotatable relative to the upper edge of the lower end 24 of the wall 23 from the normal operating orientation of the water chamber 6 prior to water flowing out of the opening 15 when the level of water in the water chamber 6 in its normal operating orientation is equal to the level of the upper edge of the lower end 24 of the wall 23. It will be understood that the level of the upper edge of the lower end 24 of the wall 23 is defined by the level of the uppermost portion of the free end of the wall 23 when the water chamber 6 is in its normal operating orientation.

That is:

$$A = Y \times \text{Sin } Z$$

wherein A is the distance between the level of the upper edge of the lower end 24 of the wall 23 and the level of the lower edge 21 of the opening 15, Y is the distance between the upper edge of the lower end 24 of the wall and the lower edge 21 of the opening 15, and Z is the maximum angle that the lower edge 21 of the opening 15 is rotatable relative to the upper edge of the lower end 24 of the wall 23 from the normal operating orientation of the water chamber 6 prior to water flowing out of the opening 15 when the level of water in the water chamber 6 in its normal operating orientation is equal to the level of the lower end 24 of the wall 23.

For example, when the ratio of dimensions A and B is 1:1 the maximum angle by which the housing 8 may be tilted from its normal operating position without water flowing from the water chamber 6 is equal to 45 degrees. Referring to FIG. 3, the dashed line indicates the water level that the water chamber 6 would be able to hold without spilling if the wall 23 was omitted. When the housing 8 is tilted at an angle so that the level of the upper edge of the lower end 24 of the wall 23 is above the level of lower edge 21 of the opening 15 in a vertical direction, water will flow through the opening 15.

In another embodiment, a panel (not shown) is formed across the passage 25. The panel extends across the passage 25 from the lower end 24 of the wall 23. Alternatively, the panel is spaced from the lower end 24 of the wall 23. One or more apertures are formed through the panel to allow water to flow from the passage 25 into the remainder of the space defined by the housing 8.

The one or more apertures in the panel (not shown) are formed as a grill. The apertures (not shown) prevent the ingress of debris into the water chamber 6 whilst allowing the water to pass through the passage 25 into the water chamber 6. The panel may also indicate the maximum water level for filling the water chamber 6.

Figure 4:
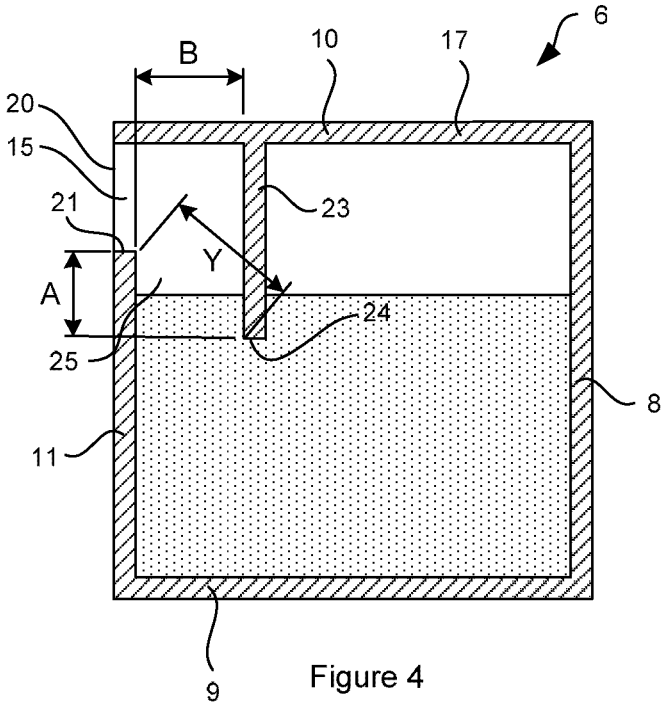
FIG. 4 shows a schematic cross-sectional side view of another embodiment of a water chamber of a base unit in a normal operating position.
Figure 5:
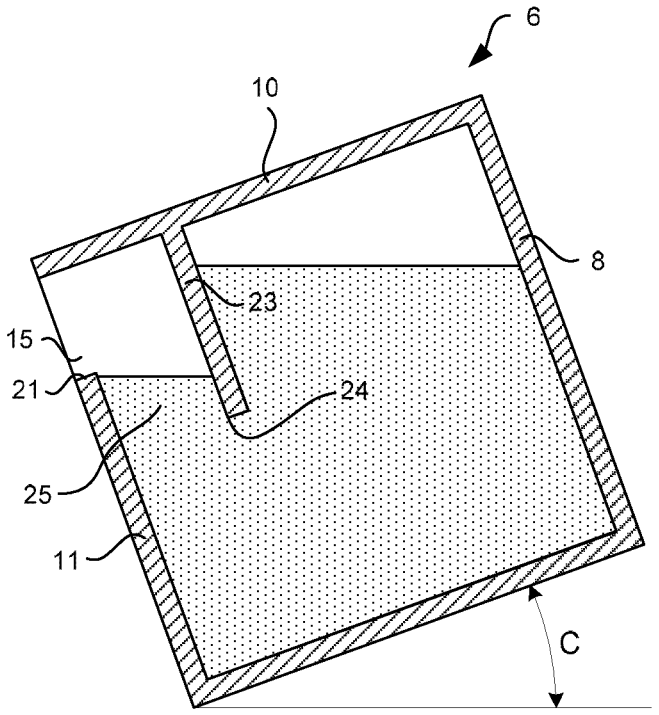
FIG. 5 shows a schematic cross-sectional side view of the water chamber of the base unit shown in FIG. 4 orientated in a tilted position.

Referring to FIGS. 4 and 5, a different arrangement of the water chamber is shown. In this arrangement, the water chamber 6 is generally the same and so a detailed description will be omitted. In the arrangement shown in FIGS. 4 and 5, the opening 15 is formed in a vertically arranged part of the housing, for example the outer sidewall 11. However, it will be understood that the opening 15 is formed in the upper portion of the housing 8 of the water chamber 6. Furthermore, the wall 23 is spaced from the opening 15. That is, the wall is spaced from the peripheral edge 20 of the opening 15. In FIGS. 4 and 5 the water chamber 6 is also shown with the water filled above the level of the upper edge of the lower end 24 of the wall 23. In this situation, it will be understood that the angle at which the water chamber 6 may be tilted before water flows over the lip formed by the lower edge 21 of the opening 15 will be lower than if a lower quantity of water is retained in the water chamber. However, it is apparent that the angle is greater than if the wall is omitted.

Figure 6:
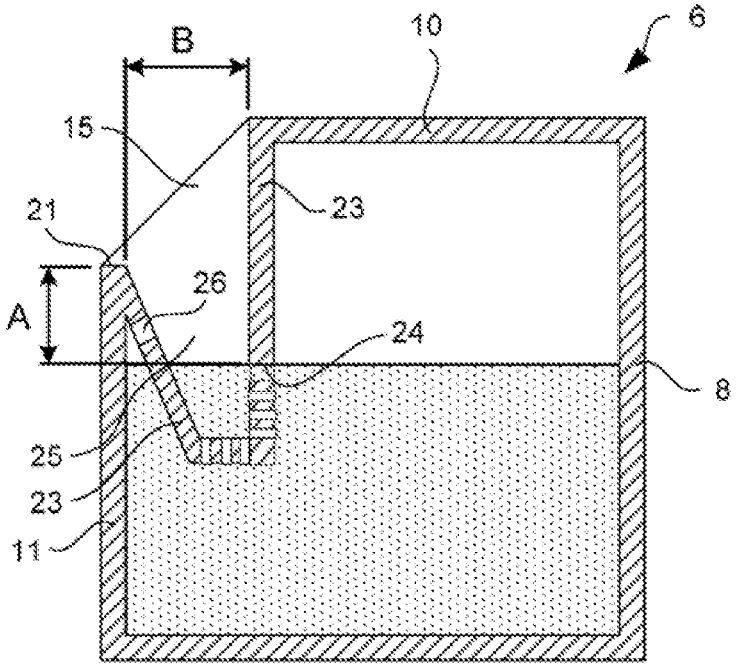
FIG. 6 shows a schematic cross-sectional side view of another embodiment of a water chamber of a base unit in a normal operating position.
Figure 7:
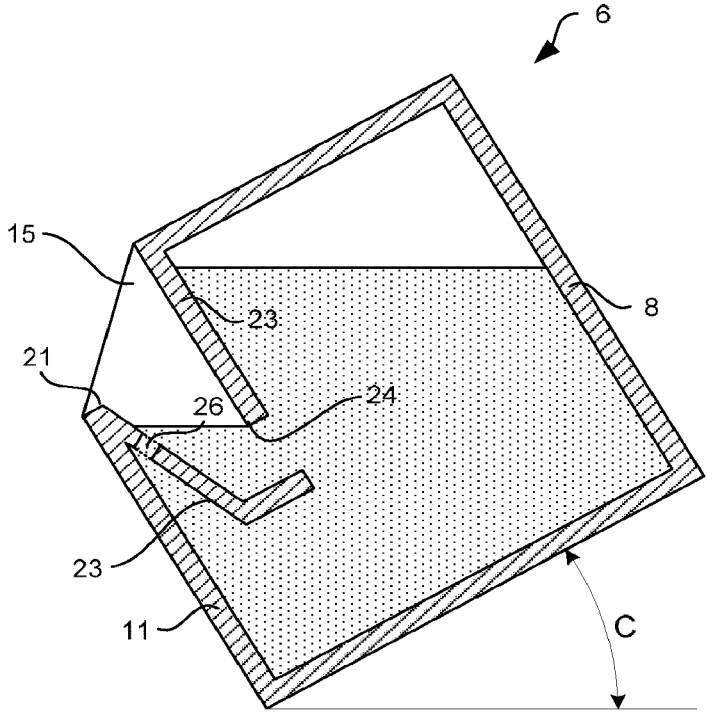
FIG. 7 shows a schematic cross-sectional side view of the water chamber of the base unit shown in FIG. 6 orientated in a tilted position.

Referring to FIGS. 6 and 7, an alternative arrangement of the water chamber 6 is shown. In this arrangement, the water chamber 6 is generally the same and so a detailed description will be omitted. In the arrangement shown in FIGS. 6 and 7, the wall 23 extends around the entire periphery of the opening 15. In such an arrangement, the passage 25 is defined by the wall 23 and is not formed by the outer sidewall 11. The lower end 24 of the wall 23 defines the communication between the passage 25 and the portion of the space defined by the housing 8.

An air release aperture 26 is formed in the wall 23 between the lower end 24 of the wall 23 and the lower edge 21 of the opening 15. The air release aperture 26 is formed through the wall 23 and communicates between the passage 25 and the remainder of the space defined by the housing 8.

When water is fed into the water chamber 6 through the opening 15 in the housing 8, the water flows along the passage 25. As water is fed into the water chamber 6 it displaces the air in the water chamber 6. If the air is not able to flow from the water chamber 6 then a blockage occurs and it is difficult for a user to feed further water into the water chamber 6. The air release aperture 26 acts as a passageway to allow air in the water chamber 6 to flow from the chamber as water is fed into the water chamber 6. The positioning of the air release aperture 26 between the lower edge 21 of the opening 15 and the free end of the wall 23 ensures that the air release aperture 26 is submerged when the water chamber 6 is tilted from its normal operating position. Therefore, air is not able to flow along the air release aperture 26 as the water chamber 6 is tilted and so the air release aperture 26 is prevented from acting as an air release passage.

It will be understood that, with reference to the above described embodiments, the level of the upper edge of the lower end 24 of the wall 23 is defined by the level of the uppermost part of the free end of the wall 23 when the water chamber 6 is tilted relative to its normal operating position. Therefore, as long as the uppermost portion of the free end of the wall is in contact with or submerged in water in the water chamber 6, then it is not possible for air to flow into the remainder of the space defined by the housing 8. Therefore, water will not flow out of the opening.

Although in the above-described embodiments, the water chamber is integrally formed with the housing of the base unit, it will be understood that in an alternative embodiment the water chamber may be formed in a removable part.

Although a boiler is used to convert water to steam in the above-described embodiments, it will be understood that the steam generator may be any suitable unit that is configured to convert water into steam.

Although in the above described embodiments the boiler, acting as a steam generator, is disposed in the base unit, it will be appreciated that in an alternative embodiment that the boiler may be disposed in the head unit. In such an arrangement, a pump is disposed in the base unit to feed water from the water chamber, along the hose to the head unit. The water is then converted to steam by the boiler in the head unit.

Although in the above described embodiments the steaming appliance is a system steam iron, it will be understood that the invention is not limited thereto and that the steaming appliance may be or form part of another device that generates steam, for example a garment steamer.

It will be appreciated that the term "comprising" does not exclude other elements or steps and that the indefinite article "a" or "an" does not exclude a plurality. A single processor may fulfill the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A water chamber for a steaming appliance comprising a housing having a base, an opening in the housing through which water is able to be fed into the water chamber, and a wall distending from the housing into the water chamber to define a passage in the water chamber extending from the opening, the distance between the level of an upper edge of a lower end of the wall and the base being less than the distance between the level of a lower edge of the opening and the base so that water is restricted from flowing along the passage from the water chamber when the water chamber is tilted from its normal operating orientation, a panel extending across the passage, wherein one or more apertures are defined in the panel, wherein the level of the upper edge of the lower end of the wall is defined as the edge of the one or more apertures defined in the panel, and wherein an air release aperture is formed in the wall to allow the release of air when water is fed into the water chamber through the opening.

2. A water chamber according to claim 1, wherein the opening is provided at an upper portion of the housing.

3. A water chamber according to claim 1, wherein $$A = Y \times \text{Sin } Z$$

wherein A is the distance between the level of the upper edge of the lower end of the wall and the level of the lower edge of the opening, Y is the distance between the upper edge of the lower end of the wall and the lower edge of the opening, and Z is the maximum angle that the lower edge of the opening is rotatable relative to the upper edge of the lower end of the wall from the normal operating orientation of the water chamber prior to water flowing out of the opening when the level of water in the water chamber in its normal operating orientation is equal to the level of the upper edge of the lower end of the wall.

4. A water chamber according to claim 1, wherein the difference between the level of the upper edge of the lower end of the wall and the level of the lower edge of the opening is at least 3 mm.

5. A water chamber according to claim 1, wherein the wall extends around the periphery of the opening to define the passage.

6. A water chamber according to claim 1, wherein the housing has a sidewall, the wall and the sidewall being arranged such that the passage is defined between the wall and the sidewall.

7. A water chamber according to claim 1, wherein the air release aperture is formed in the wall between the lower edge of the opening and the lower end of the wall.

8. A water chamber according to claim 1, wherein the housing comprises an upper wall and the wall distends downwardly from the upper wall.

9. A water chamber according to claim 1, wherein the housing further comprises a water inlet part, the opening and the wall being defined by the water inlet part.

10. A base unit for a steaming appliance comprising a water chamber according to claim 1.

11. A garment steamer comprising a base unit according to claim 10.

12. A system steam iron comprising a base unit according to claim 10.

* * * * *